US006188414B1

(12) United States Patent
Wong et al.

(10) Patent No.: US 6,188,414 B1
(45) Date of Patent: Feb. 13, 2001

(54) INKJET PRINTHEAD WITH PREFORMED SUBSTRATE

(75) Inventors: Marvin Glenn Wong; Melissa D. Boyd; Timothy E. Beerling, all of Corvallis, OR (US)

(73) Assignee: Hewlett-Packard Company, Palo Alto, CA (US)

( * ) Notice: Under 35 U.S.C. 154(b), the term of this patent shall be extended for 0 days.

(21) Appl. No.: 09/430,534

(22) Filed: Oct. 29, 1999

Related U.S. Application Data

(63) Continuation of application No. 09/070,864, filed on Apr. 30, 1998.

(51) Int. Cl.[7] ..... B41J 2/155
(52) U.S. Cl. ..... 347/42; 347/50; 347/87
(58) Field of Search ..... 347/50, 58, 42, 347/87

(56) References Cited

U.S. PATENT DOCUMENTS 4,622,574 * 11/1986 Garcia ..... 357/55
4,727,384 2/1988 Tsuda ..... 346/140 R
4,789,425 12/1988 Drake et al. ..... 156/644
4,940,413 7/1990 Childers et al. ..... 439/67
4,940,998 7/1990 Asakawa ..... 346/140 R
5,345,256 9/1994 Stortz ..... 347/20
5,686,949 * 11/1997 Swanson et al. ..... 347/87
5,689,296 * 11/1997 Heitmann et al. ..... 347/50

* cited by examiner

*Primary Examiner*—John Barlow
*Assistant Examiner*—Michael S. Brooke
(74) *Attorney, Agent, or Firm*—Michael D. Baker; Raymond A. Jenski

(57) ABSTRACT

A robust printhead is disclosed comprising a substrate, an ink flow channel formed in the substrate, a beveled die having disposed heater resistors and which is inserted into the substrate, a TAB circuit used to electrically couple the beveled die to the substrate, and an encapsulated upper surface. The encapsulant is disposed at least over the electrical coupling between the beveled die and the interconnect.

22 Claims, 8 Drawing Sheets

INKJET PRINTHEAD WITH PREFORMED SUBSTRATE

FIELD OF THE INVENTION

This invention is a continuation of U.S. patent application Ser. No. 09/070,864, filed on behalf of Timothy Beerling, et al., on Apr. 30, 1998 and assigned to the assignee of the present invention. This invention relates to inkjet printheads and more particularly to an apparatus and method of electrically and fluidically coupling an ink-ejecting die to a printhead.

BACKGROUND OF THE INVENTION

Printers are devices that print images onto a printing medium such as a sheet of paper. Various types of printers exist offering a range of printing speeds, printing colors, and printing quality. Printers are commonly linked to computers (printing system) that generate the content of images, text, or graphics being printed.

Thermal inkjet printers (a type of ink jet printer) eject small drops of ink onto a printing medium, these droplets of ink form the image, text, and graphics generated by the computer. Modem inkjet printers are capable of producing photographic-quality images and are generally less expensive than conventional laser-type printers because the printing mechanism is less expensive to produce. Additionally, thermal inkjet printers are quiet (as compared to conventional impact printers) because there is no mechanical impact during the formation of the image other than the deposition of ink onto the printing medium. Thermal inkjet printers typically have a large number of individual ink-ejecting nozzles (orifices) disposed in a printhead. The nozzles are spatially positioned and are facing the printing medium. Beneath each nozzle is a heater resistor that thermally agitates the ink when an electrical pulse energizes the heater resistor. Ink residing above the heater resistor is ejected through the nozzle and towards the printing medium as a result of the electrical pulse. Concurrently, the printhead traverses the surface of the printing medium with the nozzles ejecting ink as instructed by the printing system. For high-speed printers, however, an array of printheads may be stationary relative to the printing medium while motion is imparted to the printing medium.

As ink is ejected from the printhead, the ink droplets strike the printing medium and then dry forming "dots" of ink that, when viewed together, create a printed image. Most thermal inkjet printing systems are constructed with a permanent printer body and a disposable or semi-disposable printhead. The printhead includes a die and a supporting substrate. Furthermore, ink may be supplied to the printhead from a reservoir attached to the printer. This configuration allows the printer to operate over an extended period of time prior to having the ink replenished.

In a conventional printhead, a die having disposed heater resistors and accompanying ink-ejecting nozzles is fluidically and electrically coupled to a substrate. The fluidic coupling of the die may be achieved by attaching the die to the substrate wherein ink flows to the heater resistors (disposed in the die) from the edge of the die or from the center of the die. In either configuration, however, the ink reaches the heater resistors and is available to be ejected onto the printing medium. Electrical connections (interconnects) are also made between the pen body and the die. In a conventional printhead, one of the pen body's functions (in view of the electrical coupling) is to support an interconnect circuit that supplies power to the die upon inserting the printhead into the printer.

The electrical coupling of a die to the substrate as performed in inkjet technology is sufficiently more complicated than electrically coupling a die to a substrate as commonly performed in conventional integrated circuit packaging. For example, the interconnects must be isolated from ink being ejected from the die due to the potential corrosiveness of ink. Additionally, certain constituents of the ink may be conductive thus causing electrical shorting of the interconnects. Secondly, the interconnects are exposed to continuous vibration and physical contact by the printer. The vibration is created, in part, from the traversing movement of the printhead relative to the printing medium whereas the physical contact between the printhead and the printer occurs during the cleaning cycle of the die. The cleaning cycle involves periodically passing a wiper across the die which removes ink residue and other particles that may degrade printing performance. Thirdly, the interconnects are exposed to a wide range of temperatures stemming from the printing demands of the computer system. Consequently, the temperature of the die may rise sharply followed by an immediate cooling period. Thermal cycling of the die as such may fatigue the electrical interconnects causing them to break.

Fluidic coupling of the die to the pen body may be equally challenging. Firstly, the vibration and cleaning of the printhead, as previously described, may create microcracks between the die and pen body interface. Consequently, ink may leak onto the printing medium, thus, ruining the image being printed. Additionally, the leaking ink may serve to degrade the electrical interconnects. In a similar manner, temperature variations may further exacerbate microcracking between the die and the pen body. A further consideration in view of fluidically (and electrically) coupling the die to the substrate is the distance between the printhead and the printing medium. In general, it is desirable to minimize this distance and thereby minimize errors in the trajectory of ink being ejected from the die.

Although many attempts have been made, and indeed are ongoing, to resolve challenges previously described in coupling the die to the pen body, there still remains a need for an improved printhead. An improved printhead as such would consist of electrical interconnects that are isolated from the ink and cleaning mechanism of the printer, electrical interconnects that are tolerant of rapid temperature changes and, an ink ejecting die that would operate in close proximity of the printing medium.

SUMMARY OF THE INVENTION

A print cartridge comprising an encapsulant, an interconnect circuit, a beveled die including a plurality of orifices for ejecting ink, a substrate with an upper and lower surface and including a groove formed in the upper surface. The groove has a bottom surface that channels ink to the beveled die. The beveled die is fluidically sealed to at least a portion of the bottom surface of the groove. An interconnect circuit is disposed on an upper surface of the substrate and is electrically coupled to an upper surface of the beveled die. Finally, the encapsulant is disposed at least over the electrical interconnect and between the beveled die.

DETAILED DESCRIPTION OF A PREFERRED EMBODIMENT

The aforementioned challenges associated with fluidically and electrically coupling the die to the pen body have been resolved as exemplified in a preferred embodiment of the present invention. In its simplest form, the present invention provides a planar encapsulated electrical interconnection to an integrated printhead assembly. The encapsulant protects the electrical interconnection and fluidically seals the printhead die to the supporting substrate.

Figure 1A:
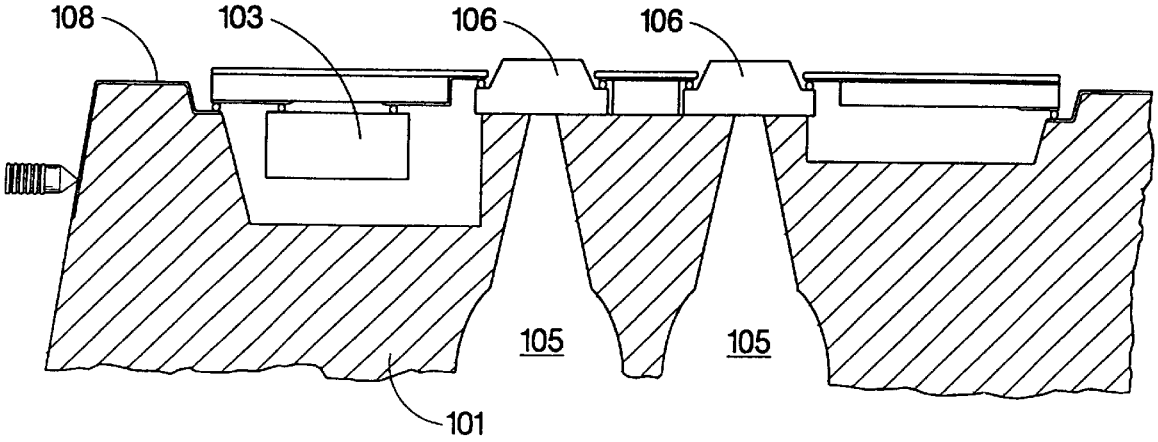
FIG. 1A is a conventional Fully Integrated Thermal (FIT) ink jet printing system comprising a beveled die.

A preferred embodiment of the present invention incorporates a beveled die 106 as shown in a conventional Fully Integrated Thermal (FIT) ink jet printing system (FIG. 1A). In the FIT printing system, the beveled die is electrically coupled to an ink cartridge body 101 and an integrated circuit 103 via a Tape Automated Bonding (TAB) circuit 107 (For an additional illustration of how a TAB circuit is used in conjunction with an inkjet die, refer to U.S. Pat. No. 4,827,294 assigned to Hewlett Packard Co.). Ink is received by the beveled die through ink ducts 105, as shown in FIG. 1A that are formed in the cartridge body 101. In a preferred embodiment of the present invention, the beveled die 106 is similarly configured to receive ink from a substrate as described below.

Figure 1B:
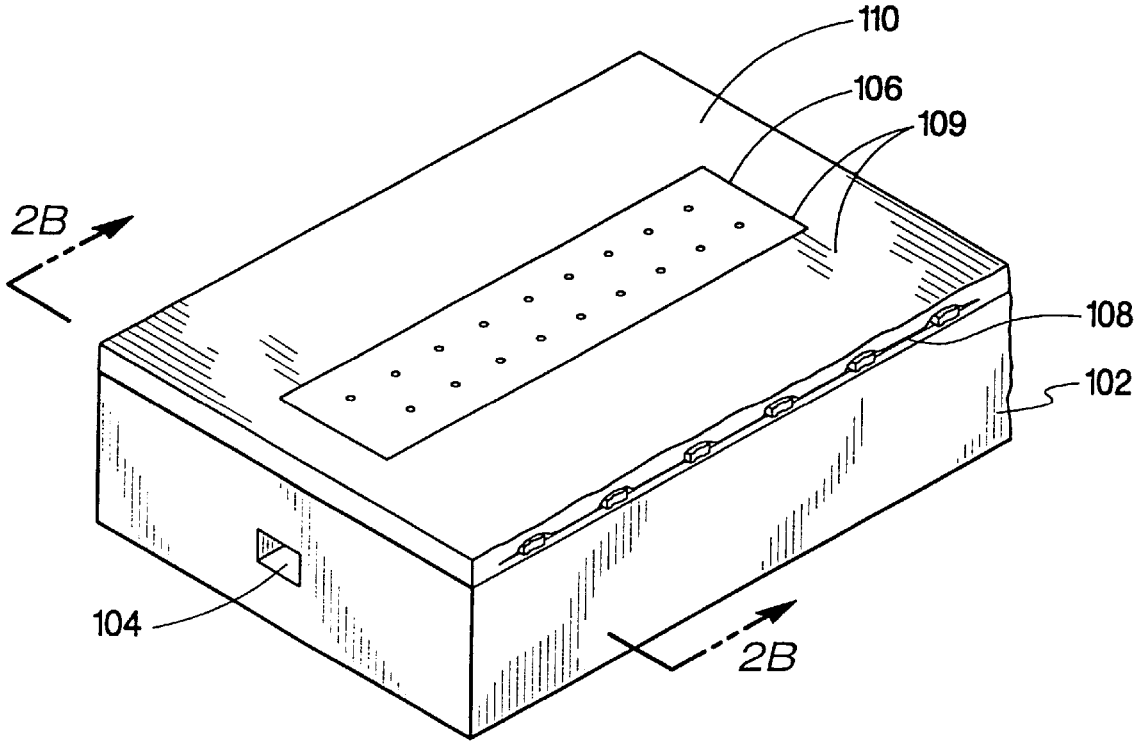
FIG. 1B is a perspective view of a preferred embodiment of the current invention.
Figure 2B:
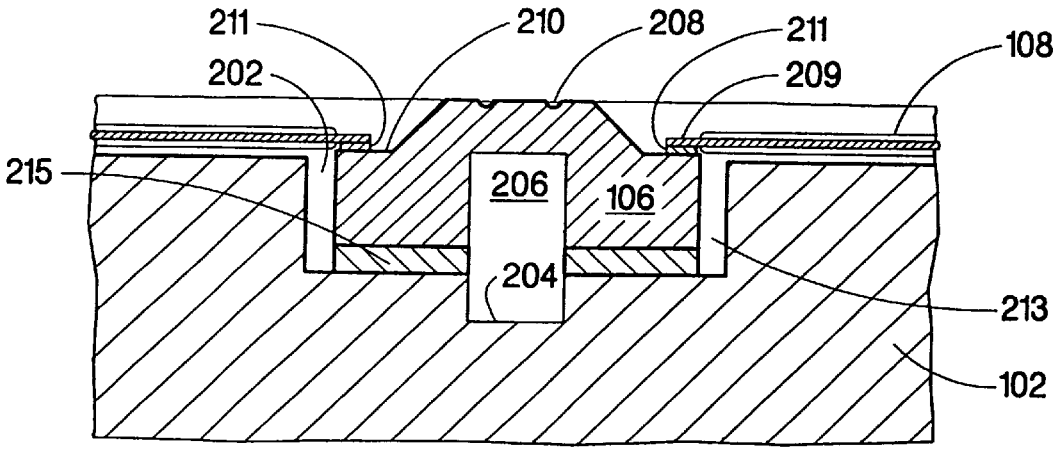
FIG. 2B is a cross section of FIG. 1B showing the insertion of a beveled die.
Figure 2A:
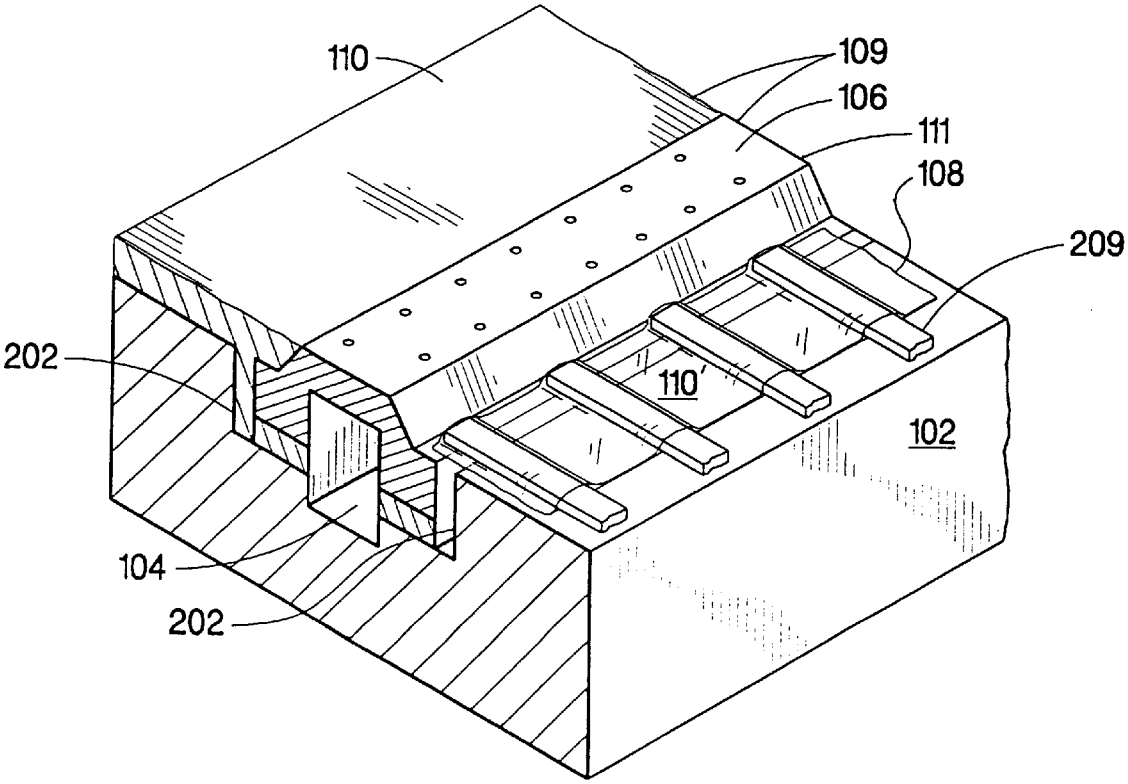
FIG. 2A is a partial cross section of a perspective view of FIG. 1B.

FIG. 1B illustrates a preferred embodiment of the current invention comprising a substrate 102, an external ink coupling slot 104 formed in the substrate, the aforementioned beveled die 106 having disposed therein heater resistors and which is inserted into provisions made in the substrate 102, a TAB circuit 108 (as previously described) is used to couple the beveled die to the substrate and, an encapsulated upper surface 110. FIG. 2A illustrates a perspective cross-sectional view of FIG. 1B; however, the encapsulated upper surface (encapsulant) is partially removed 110' to further illustrate the TAB circuit 108. In a preferred embodiment of the present invention, the substrate 102 (FIG. 2A) is formed from molded plastic, although a variety of materials may be used including, but not limited to, silicon, ceramic, and metal. The substrate has a coefficient of thermal expansion (CTE) that is compatible with the TAB circuit 108, beveled die 106, and encapsulant 110. Additionally, the substrate is impervious to ink (which may be corrosive) and contains a groove 202, as shown in FIG. 2A, in which the beveled die is inserted. The groove 202 as shown in FIG. 2B, which is a cross-section of FIG. 1B, has at its base (bottom surface) a trench 204 through which ink is distributed to the beveled die. The ink passes from the trench 204 to the beveled die 106 and subsequently to a heater resistor (not shown) that is disposed beneath each ink-ejecting orifice 208.

Figure 4:
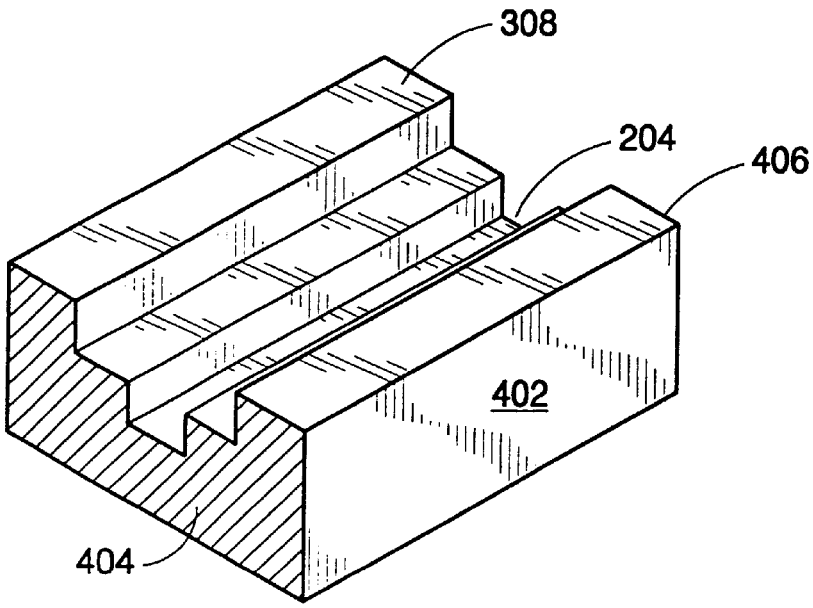
FIG. 4 is a substrate wherein a front portion and a rear portion of the substrate are open as compared to FIG. 3.
Figure 3:
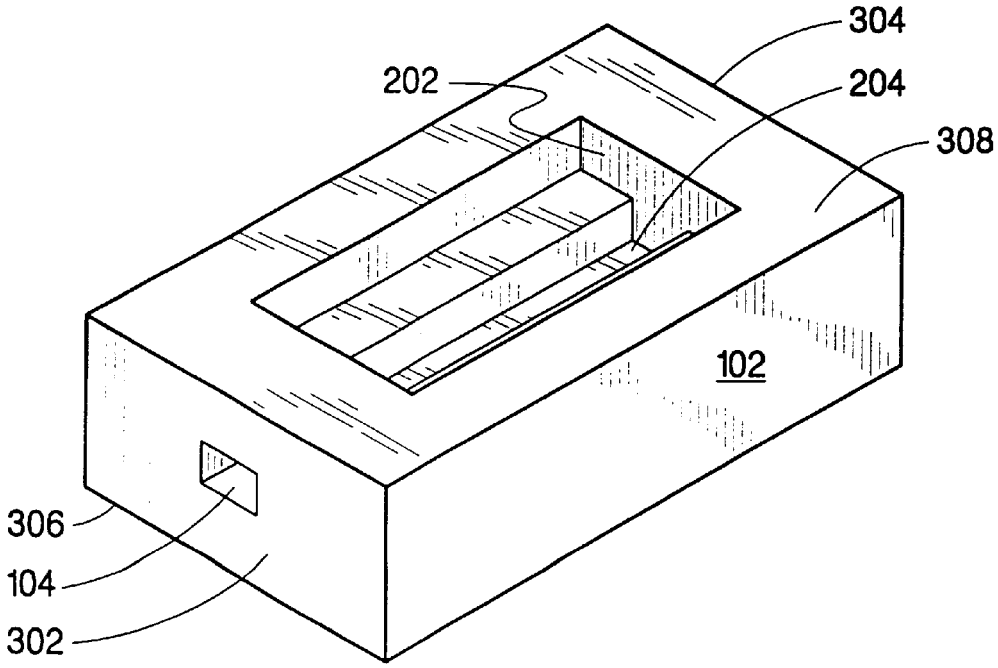
FIG. 3 is a substrate having an opening that allows ink to flow to the inserted die.

FIG. 3 shows a perspective view of the substrate 102 shown in FIG. 1B. The substrate has a front surface 302 and a rear surface 304. The bottom of the substrate is sealed thereby retaining the ink in the substrate trench 204. The front surface 302 of the substrate contains an external coupling slot 104 that allows ink to enter or exit the substrate. In a preferred embodiment of the present invention, the ink supplied to the substrate resides in an ink reservoir (not shown). The top surface 308 of the substrate is planar and capable of supporting electrical interconnects, as will be described shortly. FIG. 4 shows a substrate 402 similar to that of FIG. 3 however, the front portion 404 and the rear portion 406 are open.

Figure 2C:
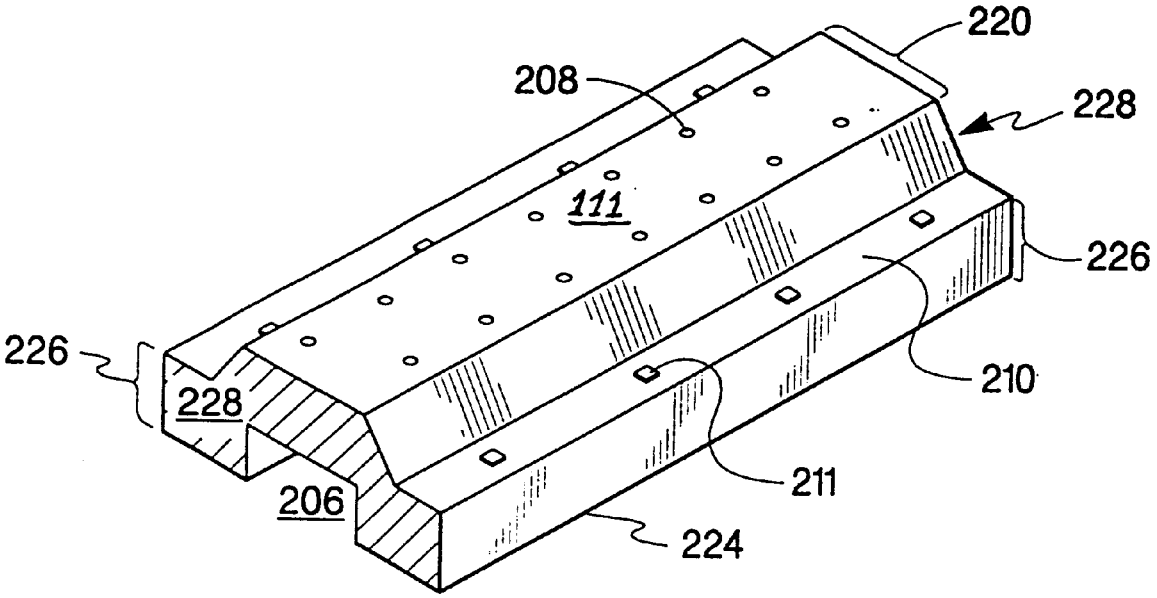
FIG. 2C is a perspective view of a beveled die.

The beveled die shown in FIG. 2C comprises an upper surface 111 having disposed heater resistors (not shown), a predetermined periphery 220, and a lower surface 224. An intervening surface 210 is disposed between the upper surface 111 and the lower surface 224. The intervening surface contains an array of electrical pads 211 upon which insulated conductors (interconnect) are attached. The lower surface and the intervening surface is aligned 226 on four lateral sides (not all shown) and extends beyond the predetermined periphery 220 of the upper surface 111. In a preferred embodiment of the current invention, the beveled die consists of two opposing lateral surfaces 228 comprising a horizontal alignment of the upper surface 111, the lower surface 224, and the intervening surface 210. A plurality of orifices 208 is disposed in the upper surface 111 and an inkfeed channel 206 is formed in the lower surface. The inkfeed channel substantially extends from the lower surface to the upper surface wherein ink may be received by the plurality of orifices.

The beveled die 106, as shown in FIG. 2C, is inserted into the substrate 102 and an adhesive 215 (FIG. 2B) is used to attach the beveled die to the substrate. The adhesive may be selected from a group of materials including, but not limited to, epoxies, polyimides, and isocyanate esters. Furthermore, the adhesive 215 is impervious to ink and possesses a CTE compatible with the surrounding materials. In an embodiment of the present invention, the encapsulant may serve as the adhesive.

A typical CTE for the substrate 102 (refer to FIG. 2A) used in an embodiment of the present invention is between 3–50 ppm/° C. Once the beveled die has been attached to the substrate as shown in FIG. 2B, the TAB circuit 108 is then electrically coupled to the beveled die 106. The TAB circuit may comprise a flexible polymer support as a sheet material and enclosed conductors or a rigid insulator and enclosed conductors. The electrical coupling established by the TAB circuit allows the beveled die to receive power and printing instructions from other printer components. In a preferred embodiment of the current invention, leads 209 of the TAB circuit 108 (FIG. 2B) intersecting the beveled die 106 are gang bonded (multiple bonds are simultaneously made) to the electrical pads 211 disposed on the intervening surface 210 of the beveled die 106. However, the leads 209 may be individually bonded using solder bumps, conductive adhesives, thermosonic or pressure bonding.

To insure a fluidic seal around the inserted beveled die that prevents ink leakage, the gap 213 between the beveled die and the substrate is filled with an encapsulant material (hereafter referred to as an encapsulant). The encapsulant 110 is disposed such that the top surface of the encapsulant is coplanar 109, as shown in FIG. 2A, with the upper surface 111 of the beveled die 106. The flush configuration avoids damage to the electrical interconnect by the cleaning mechanism of the printer because the interconnects are disposed substantially beneath the encapsulant. Additionally, this configuration avoids leaving puddles of ink that may otherwise form on the beveled die during operation. It also allows for minimum distance to exist between the beveled die and the printing medium. In a preferred embodiment of the present invention, the coplanar interface 109 between the encapsulant and beveled die eliminates particles and ink residue from adhering to the joined surfaces thus allowing the minimum distance to exist without such particles and residue rubbing on the printed medium. The encapsulant also forms a strong mechanical bond between the beveled die and the substrate that is capable of withstanding thermal and mechanical stresses. Furthermore, the encapsulant is impervious to ink and therefore provides additional protection against leaks that may stem from micro-cracking of the adhesive used to fluidically seal the beveled die to the substrate.

Figure 5B:
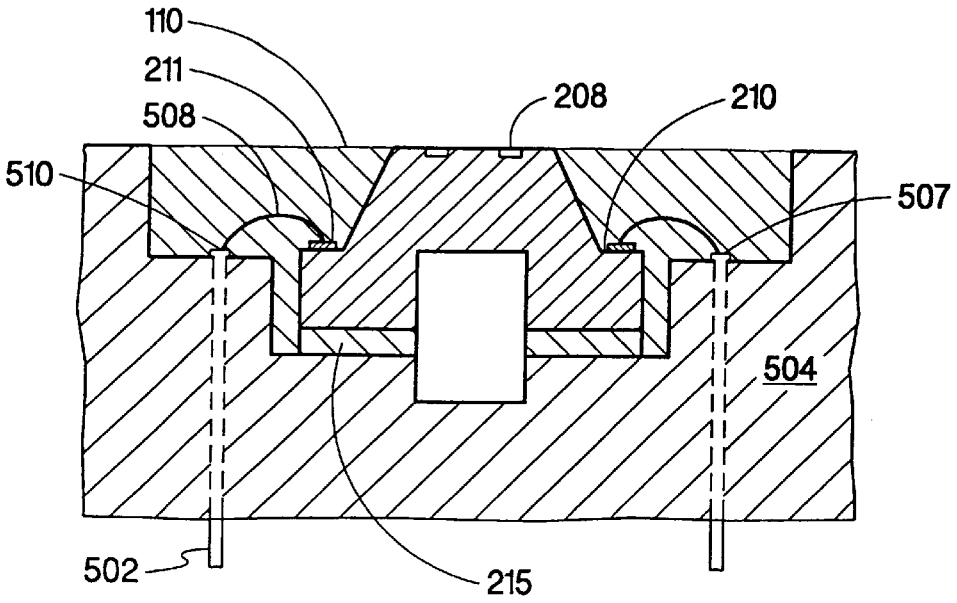
FIG. 5B is a cross section of the FIG. 5A with an inserted beveled die.
Figure 5A:
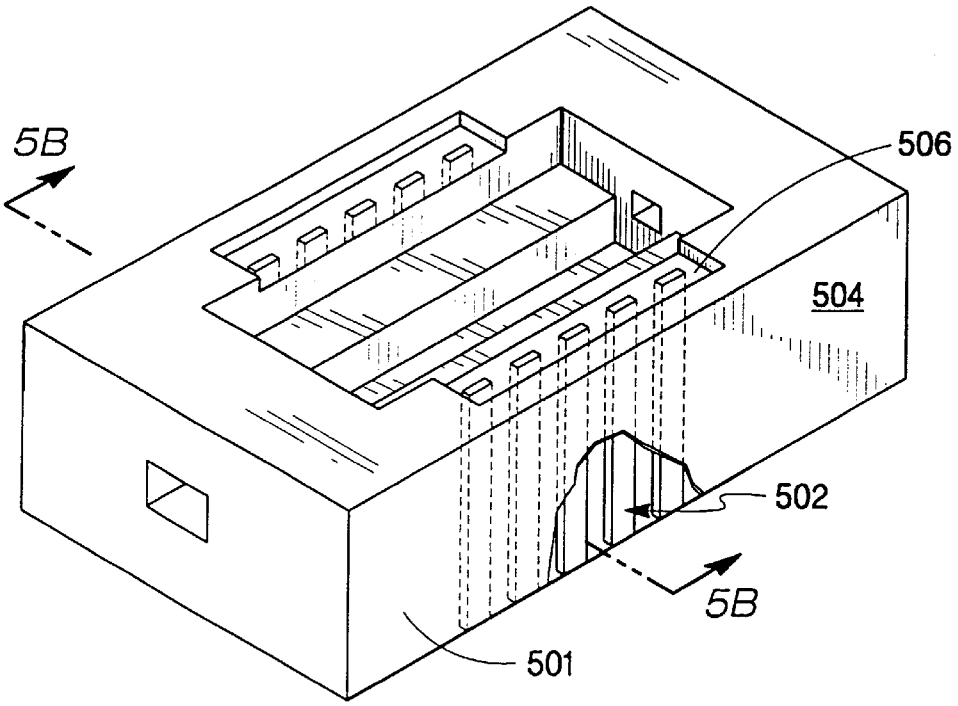
FIG. 5A is a substrate comprising a recessed notch and imbedded electrical conductors.
Figure 5C:
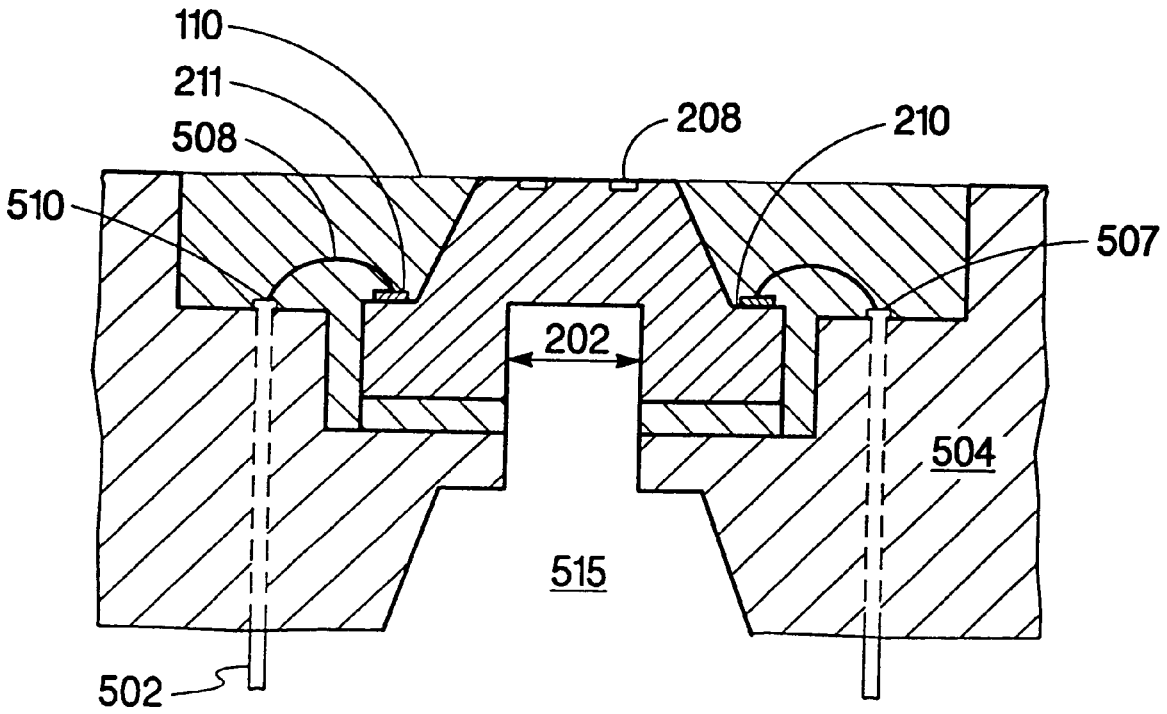
FIG. 5C is a cross section of the FIG. 5A with an inserted beveled die and an opening wherein an external ink reservoir is coupled.

FIG. 5A illustrates a substrate wherein electrical conductors 502 are disposed in the sidewalls 501 of the substrate. The substrate 504, in contrast to the aforementioned substrate 102, has a recessed notch 506 in the upper surface of the sidewall 501 which serves as a platform for electrically coupling the beveled die. An advantage of this design, as will be illustrated shortly, is the lowering (recess) of the interconnect circuit into the substrate thereby further protecting the interconnect circuit from the ink and cleaning mechanism of the printer. FIG. 5B shows a cross-section of FIG. 5A wherein the beveled die has been inserted into the substrate 504. The beveled die is attached to the substrate using an adhesive 215 as previously described. However, individual electrical wires 508 are used to couple electrical pads 211 of the beveled die to the electrical conductors 502 instead of the TAB circuit previously described. The electrical wires 508 may be attached to the electrical pads 211 on the beveled die using solder bumps, conductive adhesives, or thermal pressure bonding. Likewise the opposing end 510 of the electrical wire 508 is bonded to the interconnect 502 bonding pad 507. The encapsulant 110 is malleable when it is initially disposed on top of the substrate using an extrusion coating technique. However, as it hardens, it becomes permanently affixed to the substrate and thereby substantially enclosing the beveled die and sealing the interconnects. FIG. 5C shows a modification of the substrate 504 having an opening 515, formed beneath the groove 202 of the substrate. This configuration, which is similar to that shown in 105 (refer to FIG. 1A), allows ink to be readily coupled into the substrate from an external ink reservoir (not shown). The ink enters the substrate 504 from its lower surface and is supplied to the heater resistors through the inkfeed channel formed in the die.

Figure 6A:
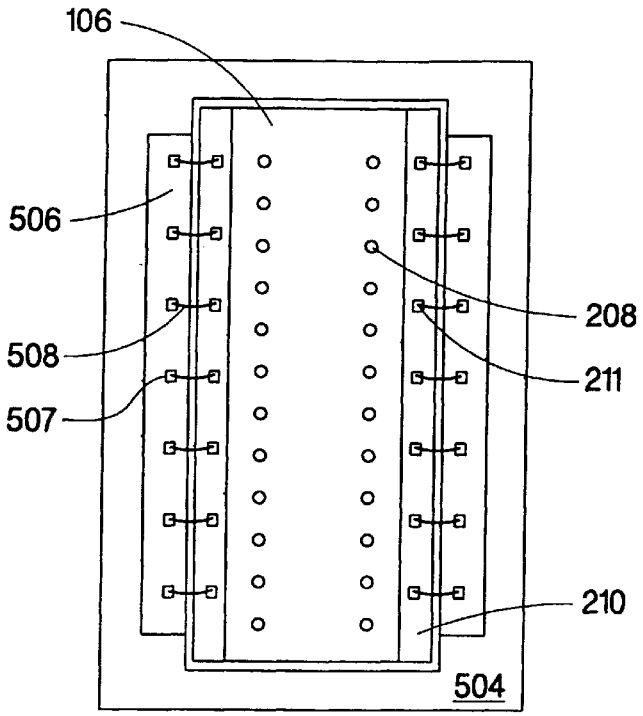
FIG. 6A is a top view of the FIG. 5A with an inserted beveled die and with the encapsulant removed.
Figure 6B:
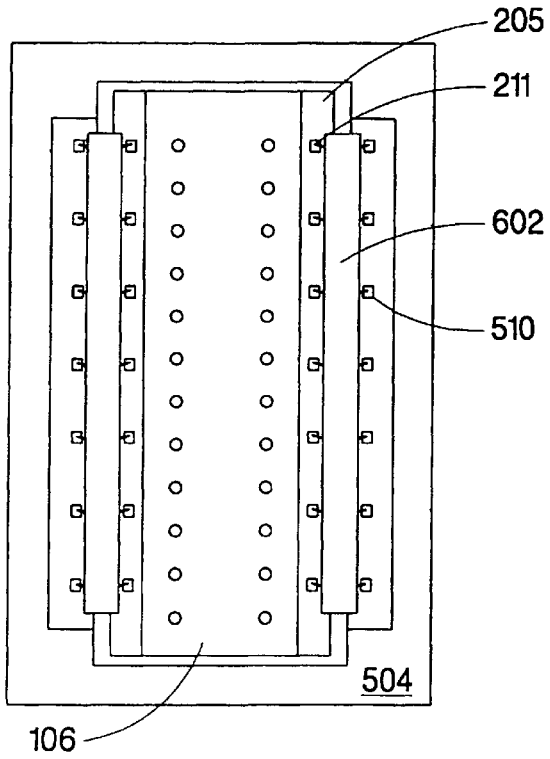
FIG. 6B shows a TAB circuit being used as the electrical interconnect between the beveled die and a substrate having a recessed notch with imbedded electrical conductors.

FIG. 6A shows a top view of the beveled die inserted into the substrate 504 before the encapsulant is disposed. FIG. 6B shows a preferred embodiment of the present invention wherein a TAB circuit 602, in contrast to FIG. 6A, is used to connect the beveled die 106 to the substrate 504. By incorporating the TAB circuit, an increased number of interconnects which may support a higher level of functionality of the beveled die is realized. For example, when the encapsulant is initially disposed on top of individual wires such as 508, (FIG. 5B) the wires may bend and consequently form an electrical short. To reduce the possibility of shorting the wires during the extrusion of the encapsulant, the electrical pads 211 may be spaced further apart. However, since a TAB circuit comprises wires (conductors) that are electrically separated by an insulating material, the extrusion of the encapsulant does not impact the wires. Therefore, by using a TAB circuit 602 as illustrated in FIG. 6B, the electrical pads 211 may be placed closer together.

A preferred embodiment of the current invention herein disclosed provides a robust printhead having several advantages as compared to a conventional printhead including but not limited to: (1) interconnects between a beveled die and a substrate that are below the top surface of the printhead, (2) a substrate and beveled die mechanical interface that establishes an inkfeed channel through which ink is channeled into the beveled die, (3) electrical interconnects that are solidified in an encapsulant and therefore protected from chemical etching of the ink and vibrational/physical forces generated by the printer, and (4) minimized die to printing medium distance.

We claim:

1. A print cartridge comprising:

an encapsulant;

an interconnect circuit;

a beveled die including a plurality of orifices for ejecting ink; and a substrate with an upper and lower surface and including a groove formed in said upper surface, said groove having a bottom surface configured for channeling ink to said beveled die, said beveled die being fluidically sealed to at least a portion of said bottom surface of said groove, said interconnect circuit being disposed on at least a portion of said upper surface and having an electrical coupling to said beveled die, said encapsulant being disposed at least over said electrical coupling between said beveled die and said interconnect circuit, said encapsulant being substantially coplanar with said upper surface of said beveled die.

2. The print cartridge of claim 1 wherein said substrate is impervious to ink.

3. The print cartridge of claim 1 wherein said beveled die further comprises:

an upper surface having a predetermined periphery;

a lower surface;

an intervening surface disposed between said lower surface and said upper surface, said lower surface and said intervening surface being aligned on four lateral sides and extending beyond said predetermined periphery of said upper surface;

at least two opposing lateral surfaces comprising a horizontal alignment of said upper surface, said lower surface, and said intervening surface;

a plurality of orifices disposed in said upper surface; and an inkfeed channel formed in said lower surface and substantially extending to said upper surface wherein ink may be received by said plurality of orifices.

4. The beveled die of claim 3 wherein said upper surface, said lower surface, and said intermediate surface are substantially parallel.

5. The beveled die of claim 3 wherein said upper surface, said lower surface, and said intermediate surface are substantially rectangular.

6. The beveled die of claim 3 wherein said lower surface is configured to receive ink from a substrate.

7. The print cartridge of claim 3 wherein said intervening surface further comprises at least one electrical pad, said electrical pad being disposed in a portion of said intervening surface extending beyond said predetermined periphery of said upper surface.

8. The print cartridge of claim 1 wherein said interconnect circuit comprises a flexible polymer support and at least one conductor.

9. The print cartridge of claim 1 wherein said interconnect circuit comprises a rigid insulator with conductors formed therein.

10. The print cartridge of claim 1 wherein said interconnect circuit is a TAB circuit, said TAB circuit is comprised of:

an insulating material selected from the group consisting of polyimide, polyester, epoxy and mixtures thereof; and a conducting material selected from the group consisting of aluminum, gold, silver, copper and mixtures thereof.

11. The print cartridge of claim 10 wherein said encapsulant substantially encloses said TAB circuit.

12. The print cartridge of claim 1 further comprising an adhesive, said adhesive affixes said beveled die to said substrate at predetermined locations whereby ink is channeled to said beveled die.

13. The print cartridge of claim 1 wherein said substrate has a coefficient of thermal expansion between 3 and 50 ppm/° C.

14. A substrate for a print cartridge comprising:

an upper surface having a groove formed therein, said groove is configured to receive a beveled die, said groove further comprising:

a bottom surface upon which said bevel die is substantially affixed; and a trench though which ink is supplied to the bevel die, said trench being fluidically coupled to an ink reservoir, said substrate having an encapsulant formed on a portion of said upper surface, said encapsulant being substantially coplanar with an upper surface of said beveled die.

15. The substrate of claim 14 wherein the fluid reservoir is fluidically coupled to said trench via a slot.

16. The substrate of claim 14 further comprising sidewalls, said sidewalls comprising metal conductors.

17. The substrate of claim 14 wherein said upper surface comprises at least one recessed notch having a metal conductor disposed therein, said metal conductor being electrically coupled to said beveled die.

18. The substrate of claim 14 is comprised of a material selected from the group consisting of silicon, ceramic, plastic, metal, and mixtures thereof.

19. A method for making an inkjet printhead comprising the steps of:

providing a substrate;

forming a groove in an upper surface of said substrate;

disposing a beveled die in said groove;

fluidically coupling said beveled die to said substrate within said groove;

disposing an interconnect circuit on an upper surface of said substrate and electrically coupling said beveled die to said interconnect circuit; and disposing an encapsulant at least over said beveled die and interconnect circuit.

20. The method of claim 19 wherein said step of disposing an encapsulant further comprises the step of depositing said encapsulant on said first surface of said substrate substantially coplanar with an upper surface of said beveled die.

21. The method of claim 19 further comprising the step of placing an adhesive within said groove thereby affixing and fluidically sealing said beveled die.

22. The method of claim 19 further comprising the step of disposing a metal conductor within said substrate whereby said beveled die is electrically coupled.

* * * * *

UNITED STATES PATENT AND TRADEMARK OFFICE

CERTIFICATE OF CORRECTION

PATENT NO. : 6,188,414 B1 
DATED : February 13, 2001
INVENTOR(S) : Marvin Glenn Wong et al.

It is certified that error appears in the above-identified patent and that said Letters Patent is hereby corrected as shown below:

Column 6,
Line 25, insert -- and an upper surface -- after the word "ink".
Line 32, insert -- substrate -- between "said" and "upper."
Line 40, Claim 3 should read:

3. The print cartridge of claim 1 wherein said beveled die further comprises:

said upper surface having a predetermined periphery;

a beveled die lower surface;

an intervening surface disposed between said beveled die lower surface and said beveled die upper surface, said lower surface and said intervening surface being aligned on four lateral sides and extending beyond said predetermined periphery of said beveled die upper surface;

at least two opposing lateral surfaces comprising a horizontal alignment of said beveled die upper surface, said beveled die lower surface, and said intervening surface;

said plurality of orifices disposed in said upper surface; and an inkfeed channel formed in said beveled die lower surface and substantially extending to said beveled die upper surface wherein ink may be received by said plurality of orifices.

4. The beveled die of claim 3 wherein said beveled die upper surface, said beveled die lower surface, and said intervening surface are substantially parallel.

5. The beveled die of claim 3 wherein said beveled die upper surface, said beveled die lower surface, and said intervening surface are substantially rectangular.

Column 6,
Line 63, insert -- beveled die -- in front of "lower."

Column 7,
Line 2, insert -- beveled die -- in front of "upper."
Line 33, delete "though" and insert -- through --.

UNITED STATES PATENT AND TRADEMARK OFFICE

CERTIFICATE OF CORRECTION

PATENT NO. : 6,188,414 B1 
DATED : February 13, 2001
INVENTOR(S) : Marvin Glenn Wong et al.

It is certified that error appears in the above-identified patent and that said Letters Patent is hereby corrected as shown below:

21. A method for making an ink jet printhead comprising the steps of:
providing a substrate;
forming a groove in an upper surface of said substrate;
disposing a beveled die in said groove;
fluidically coupling said beveled die to said substrate within said groove;
disposing an interconnect circuit on an upper surface of said substrate and electrically coupling said beveled die to said interconnect circuit; and disposing an encapsulant at least over said interconnect circuit and coplanar with an upper surface of said beveled die.

Signed and Sealed this

Twelfth Day of November, 2002

*Attest:*

*Attesting Officer*

JAMES E. ROGAN
*Director of the United States Patent and Trademark Office*